US005601698A

United States Patent [19]

Innes

[11] Patent Number: 5,601,698

[45] Date of Patent: Feb. 11, 1997

[54] PROCESS FOR REFORMING HYDROCARBON FEEDSTOCKS OVER A SULFER SENSITIVE CATALYST

[75] Inventor: Robert A. Innes, San Rafael, Calif.

[73] Assignee: Chevron Chemical Company, San Ramon, Calif.

[21] Appl. No.: 557,544

[22] Filed: Nov. 14, 1995

Related U.S. Application Data

[63] Continuation of Ser. No. 264,292, Jun. 23, 1994, abandoned.

[51] Int. Cl.[6] ..... C10G 59/02; C10G 35/04

[52] U.S. Cl. ..... 208/64; 208/134; 208/140; 208/141; 208/213

[58] Field of Search ..... 208/134, 140, 208/141, 213

[56] References Cited

U.S. PATENT DOCUMENTS

| | | | |
|---|---|---|---|
| 4,104,320 | 8/1978 | Bernard et al. | 260/673.5 |
| 4,255,250 | 3/1981 | McCoy | 208/64 |
| 4,627,909 | 12/1986 | Robinson | 208/65 |
| 4,645,586 | 2/1987 | Buss | 208/65 |
| 4,925,549 | 5/1990 | Robinson et al. | 208/65 |
| 4,929,333 | 5/1990 | Moser et al. | 208/65 |
| 4,975,178 | 12/1990 | Clem et al. | 208/65 |
| 5,190,638 | 3/1993 | Swan, III et al. | 208/65 |

FOREIGN PATENT DOCUMENTS 2323664 9/1975 France .

*Primary Examiner*—Asok Pal
*Assistant Examiner*—Bekir L. Yildirim
*Attorney, Agent, or Firm*—Burns, Doane, Swecker and Mathis

[57] ABSTRACT

Provided is a process for catalytic reforming a hydrocarbon feedstock containing at least 20 ppbw sulfur. The process comprises passing the hydrocarbon feedstock through at least two serialy connected reforming zones, with each zone containing a highly sulfur sensitive reforming catalyst. The catalyst in the first reforming zone is more frequently regenerated than the catalyst in the second reforming zone. The result is a highly efficient and simplified process for reforming a sulfur contaminated hydrocarbon feedstock. The process basically employs a minor portion of the highly sulfur sensitive reforming catalyst as both the reforming catalyst and a sulfur removal agent.

10 Claims, 2 Drawing Sheets

PROCESS FOR REFORMING HYDROCARBON FEEDSTOCKS OVER A SULFER SENSITIVE CATALYST

This application is a continuation of U.S. patent application Ser. No. 08/264,292, filed Jun. 23, 1994, now abandoned.

The present invention relates to a multi-stage process for reforming hydrocarbon feedstocks boiling in the gasoline range. The process can be used to make hydrogen, high octane streams for gasoline blending, and benzene, toluene, and/or xylene-rich streams for petrochemical use. In particular, the present invention relates to a reforming process wherein the reforming catalyst is highly sulfur sensitive.

The reforming process embraces a number of reactions such as dehydrocyclization, hydrodecyclization, isomerization, hydrogenation, dehydrogenation, hydrocracking, cracking, etc. The desired outcome is the conversion of paraffins, naphthenes, and olefins to aromatics and hydrogen. Usually, the reaction is carded out by mixing a hydrotreated hydrocarbon feedstock with recycle hydrogen and passing the mixture over a reforming catalyst at a temperature of 800°–1050° F. and a pressure of 0–600 psig.

There have recently been developed highly active and selective reforming catalysts comprising a noble metal such as platinum on a zeolite support. These catalysts are particularly effective for the conversion of $C_6$–$C_8$ paraffins to aromatics such as benzene, toluene, and xylenes which may be recovered by extraction for subsequent use in the petrochemical industry. Some of these zeolite catalysts, however, while highly selective, are rapidly poisoned by sulfur.

Nonacidic Pt-L zeolites are a prime example of such sulfur sensitive catalysts. Examples of Pt-K-L zeolite catalysts are described in U.S. Pat. Nos. 4,104,320 (Bernard et al.), 4,544,539 (Wortel), and 4,987,109 (Kao et al.). Examples of Pt-Ba,K-L zeolite catalysts are described in U.S. Pat. No. 4,517,306 (Buss et al.). It is disclosed in U.S. Pat. No. 4,456,527 that such catalysts are able to achieve satisfactory run lengths only when the sulfur content of the feed is substantially reduced, for example, preferably to less than 100 parts per billion by weight (ppbw), and more preferably to less than 50 ppbw. The lower the sulfur content of the feed the longer will be the run length.

There is provided in the patent literature several ways to obtain ultralow sulfur feedstocks. U.S. Pat. No. 4,456,527 describes a process wherein the naphtha feed is hydrofined and then passed over a supported CuO sulfur sorbent at 300° F. to produce a feed containing less than 50 parts per billion by weight (ppbw) sulfur.

In U.S. Pat. No. 4,925,549, residual sulfur is removed from a hydrotreated feedstock by reacting the feedstock with hydrogen over a less sulfur sensitive reforming catalyst, converting the residual sulfur compounds to hydrogen sulfide, and absorbing the hydrogen sulfide on a solid sulfur sorbent such as zinc oxide. In U.S. Pat. No. 5,059,304, a similar process is described except that the sulfur sorbent comprises a Group IA or IIA metal oxide on a support. In U.S. Pat. No. 5,211,837, a manganese oxide sulfur sorbent is used.

In U.S. Pat. No. 5,106,484, a hydrotreated feedstock is passed over a massive nickel catalyst and then treated over a metal oxide under conditions which result in a substantially purified naphtha. The metal oxide is preferably manganese oxide and the treatment may be carried out in the presence of recycle hydrogen.

While the sulfur removal techniques of the prior art are effective, they add to the complexity of the reforming process. For example, additional sulfur sorber and recycle-gas sulfur convertor/sorber reactors are necessary along with their associated catalyst and sorbent materials. In addition, the recycle-gas sulfur convertor/sorber reactors which typically operate under mild reforming conditions may catalyze side reactions causing some yield loss.

Accordingly, any process involving a sulfur sensitive catalyst which can reduce the need for complicated sulfur removal steps would be desirable.

It is therefore an object of the present invention, to provide a novel reforming process which involves a sulfur sensitive catalyst and is relatively simple in its approach to sulfur removal and protection of the sulfur sensitive catalyst used.

Another object of the present invention is to provide an efficient and effective reforming process which involves a sulfur sensitive catalyst.

These and other objects of the present invention will become apparent upon a review of the following specification, the drawing and the claims appended hereto.

SUMMARY OF THE INVENTION

In accordance with the foregoing objectives, the present invention provides a process for catalytically reforming a gasoline boiling range hydrocarbon feedstock containing at least 20 ppbw sulfur, but not more than 500 ppbw sulfur, in the presence of hydrogen in a process unit comprising at least two serially connected reforming zones, with each zone containing a highly sulfur sensitive reforming catalyst. More specifically, the process comprises:

(a) partially reforming said feedstock in a first reforming zone containing a highly sulfur sensitive reforming catalyst, while absorbing sulfur on the highly sulfur sensitive reforming catalyst such that the process stream leaving the first reforming zone contains less than 20 ppbw sulfur;

(b) continuing the reforming process in a second reforming zone which is in series with the first reforming zone; and, (c) regenerating the catalyst in the first reforming zone at least twice as often as the catalyst in the second reforming zone.

For the purposes of this invention, a reforming catalyst is highly sulfur sensitive if run lengths in a fixed- bed reactor with a substantially sulfur-free feed, i.e., less than 20 ppbw sulfur, are at least twice as long as when the feed contains 100 ppbw sulfur (with the run being made in the absence of a sulfur removal step).

Among other factors, the present invention is based on the discovery that sulfur deposition generally occurs over a relatively small portion of the catalyst bed when carrying out a reforming process over a highly sulfur sensitive catalyst. Thus, when a feed contains 20–500 ppbw sulfur, sulfur mass transfer from the feed to the catalyst occurs in a narrow zone which moves through the catalyst bed or series of beds as each increment of catalyst becomes poisoned. The catalytically active sites are in essence being titrated by sulfur in the feed. Thus, the process of the present invention employs a minor portion of the highly sulfur sensitive reforming catalyst itself as both a reforming catalyst and a sulfur removal agent.

Among the advantages of the process of the present invention is that the need for a recycle gas sulfur converter/ sorber such as those described in U.S. Pat. Nos. 4,925,549, 5,059,304, 5211,837, and 5,106,484 is eliminated. Thereby, the process of the present invention provides a simplified reforming process and, in some cases, improved yields of hydrogen and aromatics.

DETAILED DESCRIPTION OF THE PREFERRED EMBODIMENTS

Figure 1:
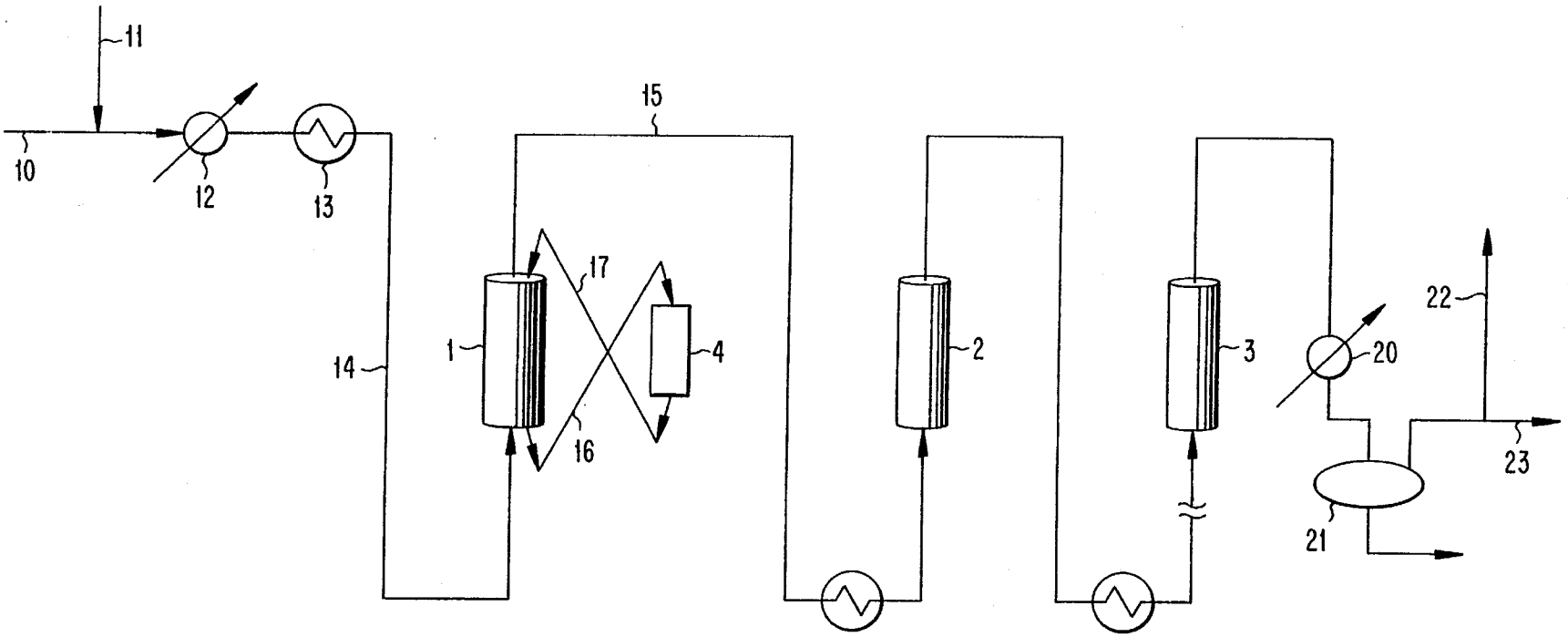
FIG. 1 of the Drawing depicts schematically a reforming process in accordance with the present invention. The process involves a countercurrent flow first reaction zone which also acts as a sulfur removal zone.

The feedstocks which are suitable for the process of this invention are hydrocarbon streams boiling substantially within the gasoline range and containing at least 20 ppbw sulfur, but preferably not more than 500 ppbw sulfur. The process of the present invention is also quite useful for hydrocrabon streams containing at least 50 ppbw sulfur, with the amount of sulfur preferably being in the range of from 50–200 ppbw. This would include streams boiling within the 70° F.–450° F. temperature range, preferably from 120° F. to 400° F. For petrochemical applications $C_6$, $C_6$–$C_7$, $C_6$–$C_8$ streams are especially preferred.

Examples of suitable feedstocks include straight-run naphthas from petroleum refining or fractions thereof which have been hydrotreated to remove sulfur and other catalyst poisons. Also suitable are synthetic naphthas or naphtha fractions derived from other sources such as coal, natural gas liquids, fluid catalytic crackers, and hydrocrackers. Usually, these will also require hydrotreating to bring their sulfur content into the desired range and remove other catalyst poisons.

Other feed pretreatment steps may include passing the feed as a liquid through a sulfur sorber containing, for example, nickel oxide or copper oxide on a support and drying the feed using molecular sieves.

The reforming reaction is carded out in two serialy connected reaction zones, each containing a highly sulfur sensitive reforming catalyst. The same catalyst would normally be used in both reactions zones, but different catalysts could be used if desired. Also, more than one highly sulfur sensitive catalyst could be employed in a single reaction zone.

The feed to the first reaction zone generally contains at least 20 ppbw sulfur, and usually in the range of from 20 to 500 ppbw sulfur. At least two-thirds of the sulfur is absorbed on the catalyst or catalysts in the first reaction zone. Preferably, 90 to 100% of the sulfur is absorbed in the first reaction zone. The feed entering the second reaction zone contains less than 20 ppbw sulfur, preferably, less than 5 ppbw sulfur, and most preferably less than 1 ppbw sulfur.

Each reaction zone may consist of one or more reactors. It is preferred that the first reaction zone be contained within a single reactor and that the second reaction zone consist of at least two reactors. In a preferred embodiment of the invention, the second reaction zone consists of three to six serially connected reactors.

Since the reforming process is endothermic, the feed is reheated between reactors. The reactors employed in this process may be any conventional reactors, but are preferably either fixed-bed or moving-bed reactors. The gas flow through each reactor may be radial-flow, up-flow, or down-flow.

In a preferred embodiment of this invention, the first reaction zone consists of a moving-bed reactor which is equipped for continuous catalyst regeneration. It is preferred that this reactor be either a radial-flow reactor or an up-flow reactor where catalyst and hydrocarbons flow in opposite directions. A radial-flow reactor will have a lower pressure drop, but an up-flow reactor often provides more efficient sulfur removal.

It is also part of this preferred embodiment, that the reactor dimensions and catalyst circulation rate be chosen so that the catalyst in the first reaction zone is regenerated, for example, from one to four times a month and that the aromatics yield and outlet sulfur concentration for the first reaction zone remain constant. It is most preferred that the catalyst in the first reactor zone is regenerated once every 5 to 14 days. It is also preferred that sulfur concentrations leaving the first reaction zone be low enough that run lengths in the second reaction zone exceed six months.

The catalyst can be regenerated in accordance with any known regeneration procedure for sulfur sensitive catalysts. For example, the patent literature provides at least two methods that have been specifically identified as suitable for regenerating a highly sulfur sensitive zeolite reforming catalyst which has been contaminated by sulfur. In Re. 34,250, issued to Van Leirsburg et at, the regeneration process is comprised of a carbon removal step, a platinum agglomeration and sulfur removal step, and a platinum redistribution step. In European patent disclosure 316,727, deactivated Pt-L-zeolite catalysts are pretreated at 500° C. with a halogen compound such as carbon tetrachloride and nitrogen. Oxygen is then added to the mixture to remove coke and, finally, the catalyst is treated with a chlorofluorocarbon compound, oxygen, and nitrogen. Continuous catalyst regeneration using the technology described, for example, in the report "Continuous reformer catalyst regeneration technology improved", by Roger L. Peer, et al, *Oil and Gas Journal,* May 30, 1988, can also be used. In the process, the catalyst moves continuously through the regeneration process by gravity, while gas streams steadily flow radially across the catalyst bed. The objective is to provide essentially continuous fresh catalyst performance.

Various other methods for regenerating sulfur contaminated catalysts are also known to those skilled in the art. The use of a process which involves sulfur removal and redispersion of platinum, however, is most preferred for regeneration of the catalyst in the first reactor zone.

In general, the reforming reaction can be carried out using conventional conditions, but is preferably carded out at temperatures ranging from 600° to 1100° F., preferably, 800° to 1050° F. Reaction pressures may range from atmospheric pressure to 600 psig but are preferably from 40 to 150 psig. The molar ratio of hydrogen to hydrocarbon feed is normally between 0.5 to 10, with the preferred range being from 2.0 to 5.0. Hydrocarbon feed weight hourly space velocity is 2.0 to 20 based on the catalyst in the first reaction zone and 0.5 to 5.0 based on the catalyst in the second reaction zone.

The reforming catalysts used in the process of this invention are highly sulfur sensitive. Such highly sulfur sensitive catalysts are well known in the industry, for example, as described in U.S. Pat. Nos. 4,456,527 and 4,925,549, the disclosures of which are hereby expressly incorporated by reference.

The sulfur sensitivity of a catalyst can be determined by carrying out two reforming runs in a fixed-bed microreactor under identical conditions. The first run should be made with a substantially sulfur-free hydrocarbon feedstock containing less than 5 ppbw sulfur, while the second run should be made with the same feed but with thiophene added to the feed to raise its sulfur content to 100 ppbw.

Substantially sulfur-free feed can be obtained by first hydrotreating the feed to bring its sulfur content below 100 ppbw and then using a sulfur convertor/sorber as described in U.S. Pat. No. 5,059,304.

Run length may be defined by allowing either a fixed temperature increase at constant aromatics yield or a given drop in conversion at constant temperature. If the run length in the presence of 100 ppbw feed sulfur is less than half that obtained with substantially sulfur-free feed, then the catalyst is said to be highly sulfur sensitive.

In order to provide a more quantitative measure of sulfur sensitivity, we define herein a test which can be used to determine a Sulfur Sensitivity Index or SSI. The test is carried out by comparing run lengths obtained with a sulfur-free feed and the same feed containing thiophene. The base feed is n-hexane which contains less than 20 ppbw sulfur. In sulfur-free case a sulfur convertor/sorber is used, while in the sulfur-added case enough thiophene is added to raise the feed sulfur content to 100 ppbw.

In each run, one gram of catalyst is charged to a 3/16" I.D. tubular microreactor. Sulfur-free reactors are used for each run. The catalyst is dried by heating to 500° F. at a rate of 50° F./h, while flowing nitrogen through the reactor at 50 psig and a rate of 500 cc/min. The catalyst is reduced at 500° F. and 50 psig with hydrogen flowing at 500 cc/min. The temperature is then raised to 900° F. at rate of 50° F.F./h while continuing to flow hydrogen.

The temperature is then lowered to about 850° F. and the reaction started. The reaction is carried out at 5.0 WHSV, 50 psig, and a hydrogen to hydrocarbon feed molar ratio of 5.0. The n-hexane free reservoir is blanketed with dry nitrogen to prevent contamination by water and oxygen and the hydrogen is also dried so that reactor effluent contains less than 30 ppm water.

The reactor effluent is analyzed by gas chromatography at least once an hour and the reaction temperature is adjusted to maintain a 50 wt % aromatics yield on feed. The runs are ended when the reaction temperature has been increased 25° F. from the extrapolated start of temperature.

The Sulfur Sensitivity Index is then calculated by dividing the run length obtained in the sulfur-free case by the run-length obtained in the sulfur-added case. In the process of this invention, it is preferred that the reforming catalysts have an SSI of at least 2.0. It is especially preferred that the SSI of the catalyst exceed 5.0, and it is most preferred that the SSI of the catalyst exceed 10.

A preferred form of highly sulfur sensitive catalyst is comprised of 0.05 to 5.0 wt % noble metal on a zeolite support. The zeolite may be mixed with an inorganic oxide binder such as alumina or silica and formed into spherical or cylindrical pieces of catalyst ¼" to 1/32" in diameter. The noble metals are preferably platinum or palladium, but some catalysts may contain in addition other noble metals as promoters, such as iridium and rhenium, which act to enhance selectivity or run length. The catalyst may also comprise non-noble metals such as nickel, iron, cobalt, tin, manganese, zinc, chromium etc.

It is preferred the zeolite support be substantially nonacidic. Zeolites having pore dimensions in excess of 6.5Å are especially preferred. Catalysts comprising a large-pore zeolite with nonintersecting channels such as zeolites L and omega are especially sulfur sensitive and benefit most from the process of this invention.

One way to determine whether a catalyst is substantially nonacidic is to immerse 1.0 gram of catalyst in 10 grams of distilled water and measure the pH of the supernatant liquid. A substantially nonacidic zeolite will have a pH of at least 8.0.

Catalysts comprising platinum on substantially nonacidic forms of zeolite L are especially preferred for the process of this invention. Such catalysts are described in U.S. Pat. Nos. 4,104,539, 4,517,306, 4,544,539, and 4,456,527, the disclosure of which are expressly incorporated herein by reference.

The present invention, therefore, provides one with an efficient and effective one-step method for protecting/removing sulfur during the reforming of a hydrocarbon feedstock while using a sulfur sensitive catalyst. The process uses a portion, preferably about 10% of the catalyst, in the first reaction zone for the purpose of removing sulfur. The first reaction zone is run under normal reforming conditions, with the catalyst simply being regenerated more often. It acts as the sulfur removal zone, and thereby the overall process offers one a unique, less complicated process for reforming hydrocarbons when using a highly sulfur sensitive catalyst. The process is extremely efficient in removing sulfur, and also offers the advantage of conducting some selective reforming while removing the sulfur. Therefore, as a sulfur removal zone, the first reaction zone performs its function while additionally beginning the selective reforming reaction in advance of the remaining reaction zones so that a significant amount of reforming is achieved during the sulfur removal.

The process of the present invention will be illustrated in greater detail by the following specific examples. It is understood that these examples are given by way of illustration and are not meant to limit the disclosure or the claims to follow. All percentages in the examples, and elsewhere in the specification, are by weight unless otherwise specified.

EXAMPLE 1

A sample of a catalyst containing 0.64 wt % platinum on barium exchanged L zeolite extrudates was tested (as described above) to determine its Sulfur Sensitivity Index. Its Sulfur Sensitivity Index was determined to be 11.

The foregoing catalyst is charged to the reforming unit pictured in FIG. 1. This reforming unit consists of a moving bed reactor (1) which comprises the first reforming zone and a series of up to 5 or more additional fixed bed reactors which comprise the second reforming zone. In the figure, only two additional reactors are shown (2,3), but others can be added. The moving bed reactor 1 is equipped so that the catalyst may be isolated from the reactant stream and transported to vessel 4 for regeneration. The reactant gases flow up through 1, while the catalyst moves down. The catalyst distribution among the reactors is 10% in the first reforming zone, 10% in the catalyst regeneration zone 4, and 80% in the second reforming zone.

The hydrocarbon feedstock is a $C_6$–$C_7$ naphtha which has been hydrotreated and passed through a sulfur sorber and a molecular sieve drier. Its sulfur content is 60 ppbw and its moisture content is less than 5 ppbw. After startup, the reforming reaction is carried out initially with the reactor inlet temperatures at 940° F. The average reactor pressures drops from 90 to 50 psig as one proceeds through the reactor train. The hydrogen to naphtha feed molar ratio entering the first reactor is 5.0. The naphtha WHSV based on total catalyst volume is 1.0.

The hydrocarbon feedstock enters the process via line 10. It is mixed with hydrogen entering via line 11 and the mixture is fed through feed/effluent exchanger 12. From 12 the mixture proceeds to furnace 13. The feed is heated to reaction temperature in furnace 13 and then proceeds via line 14 to the moving bed reactor 1.

The reactant stream proceeds upflow through 1 and leaves the reactor via line 15. The sulfur content of the effluent is less than 5 ppbw and the aromatics content is about 12 wt %. The catalyst moves down through 1 and is isolated from the feed at the bottom of reactor 1 and transported to the regenerator 4.

The catalyst moves via line 16 to the regenerator 4 which consists of a series of radial gas-flow zones. As the catalyst moves down through the regeneration vessel, it is treated by a series of gas mixtures at elevated temperatures and high velocity to remove sulfur and coke and redisperse platinum. Eventually, the catalyst leaves the regenerator via line 17 and returns to the reactor. The catalyst circulation rate is such that the average catalyst particle is regenerated about once every 5 to 14 days.

After leaving the first reforming zone, the reactant stream moves through a series of process furnaces and radial-flow, fixed-bed reactors to complete the reaction. The catalyst in the second reforming zone is regenerated in place every six to twelve months.

The effluent from the last reactor 3 is cooled by a feed/effluent exchanger and a trim cooler 20. A liquid product containing about 80 wt % aromatics is collected in the separator 21. The gaseous product from 21 is split into net gas and recycle hydrogen streams. The recycle hydrogen is returned via line 22 to the beginning of the process. The net gas 23 is further purified to provide hydrogen for the refinery and recover additional aromatics.

EXAMPLE 2

A sour-gas was injected into the hydrogen recycle system of a four-reactor reforming plant employing a nonacidic Pt-L-zeolite catalyst. The reactors were down-flow, fixed-bed, type. The catalyst was protected by a sulfur sorber. Eventually, the capacity of the sorber was exhausted and hydrogen sulfide began to break-through. There was then a sequential poisoning of the catalyst in each subsequent reactor.

Figure 2:
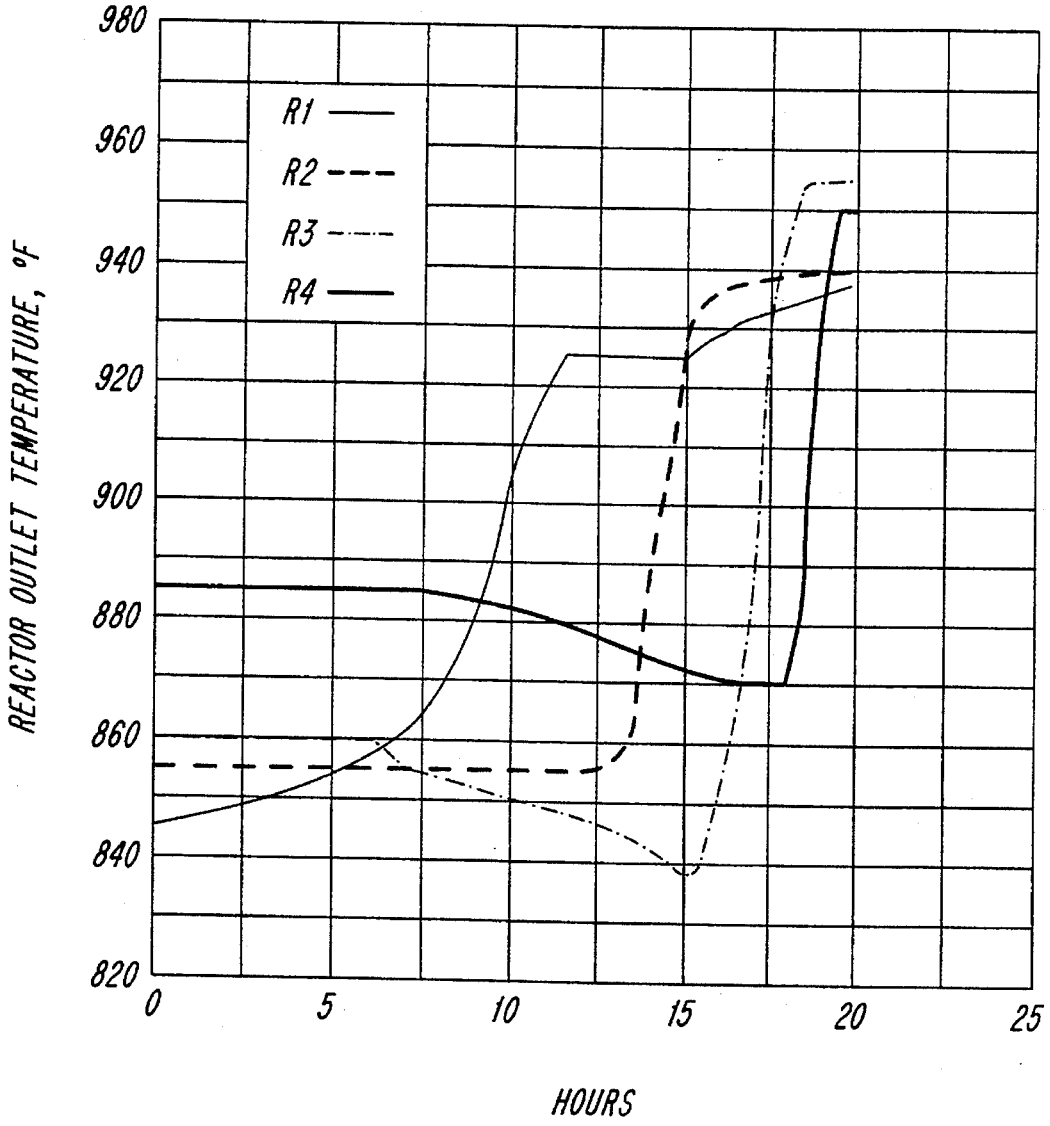
FIG. 2 of the Drawing is a graphical representation of the loss of reactor endotherms and increase in reactor outlet temperature when the catalyst beds in a multi-reactor reforming plant are poisoned by sulfur.

A loss of catalytic activity was indicated by a loss of reactor endotherm and an increase in reactor outlet temperature as shown in FIG. 2. Reactors, 2, 3, and 4, did not begin to experience a loss of endotherm until the preceding reactor was totally deactivated. The plant was shut down just after the catalyst in the last reactor had died. The sulfur content of catalyst samples taken after the incident ranged from 249 ppm in the first reactor to 149 ppm in the last reactor.

These observations show that sulfur adsorption of a nonacidic Pt-L-zeolite catalyst is very rapid and occurs over a very narrow band of catalyst. The data also show that sulfur adsorption was 100% effective until the sulfur loading on the catalyst exceeded 100 ppm. Pt-L-zeolite should therefore make a very effective sulfur-guard in a reforming process provided that it can be regenerated. Several ways to strip sulfur from a Pt-L-zeolite catalyst and redisperse platinum are known in the art, as discussed earlier. If the capacity of a Pt-L-zeolite sulfur-sorbent is assumed to be 100 ppm sulfur and the sulfur content of the stream to be treated is 0.1 ppm, then a guard-bed operating at 10 WHSV would require regeneration once every 100 hours.

While the invention has been described with preferred embodiments, it is to be understood that variations and modifications may be resorted to as will be apparent to those skilled in the art. Such variations and modifications are to be considered within the purview and scope of the claims appended hereto.

I claim:

1. A process for reforming a hydrocarbon feedstock containing at least 20 ppbw sulfur, which process comprises passing the hydrocarbon feedstock through at least first and second reforming zones which are serially connected, with each of said first and second reforming zones containing a highly sulfur sensitive reforming catalyst, and with the catalyst in the first reforming zone being regenerated more frequently than the catalyst in the second reforming zone, and with effluent from the first reforming zone being passed to the second reforming zone without removing sulfur.

2. The process of claim 1, wherein an L zeolite catalyst is employed in both of the reforming zones.

3. The process of claim 1, wherein the same catalyst is used in each reforming zone.

4. The process of claim 1, wherein the catalyst in the first reforming zone is regenerated at least twice as often as the catalyst in the second reforming zone.

5. The process of claim 1, wherein the second reforming zone comprises from 2 to 6 serially connected reactors.

6. The process of claim 1, wherein the first reforming zone is comprised of a moving bed reactor which is equipped for continuous catalyst regeneration.

7. The process of claim 1, wherein the reforming reaction in each zone is carried out at temperatures ranging from 600° to 1200° F., a pressure in the range of atmospheric to 600 psig, and a molar ratio of hydrogen to hydrocarbon feed in the range of from 0.5 to 10.

8. A process for catalytically reforming a gasoline boiling range hydrocarbon feedstock containing at least 20 ppbw sulfur in the presence of hydrogen, which process comprises passing the hydrocarbon feedstock through at least two serially connected reforming zones, with each zone containing a highly sulfur sensitive reforming catalyst, with said feedstock being partially reformed in a first reforming zone, while sulfur is absorbed on the highly sulfur sensitive reforming catalyst such that the process stream leaving the first reforming zone contains less than 20 ppbw sulfur;

with the reforming process being continued in a second reforming zone in series with the first reforming zone; and, with the catalyst in the first reforming zone being regenerated at least twice as often as the catalyst in the second reforming zone, and with effluent from the first reforming zone being passed to the second reforming zone without removing sulfur.

9. The process of claim 8, wherein the second reforming zone comprises from 2 to 6 reactors in series.

10. The process of claim 8, wherein the feed contains from 20 to 500 ppbw sulfur.

* * * * *